US010152001B2

(12) United States Patent
Kumagai et al.

(10) Patent No.: US 10,152,001 B2
(45) Date of Patent: Dec. 11, 2018

(54) IMAGE FORMING APPARATUS

(71) Applicants: Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Yuuji Wada, Kanagawa (JP)

(72) Inventors: Naohiro Kumagai, Kanagawa (JP); Seiichi Kogure, Kanagawa (JP); Junpei Fujita, Kanagawa (JP); Kazuki Yogosawa, Kanagawa (JP); Kenji Sugiura, Kanagawa (JP); Yuuji Wada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/690,484

(22) Filed: Aug. 30, 2017

(65) Prior Publication Data

US 2018/0059583 A1 Mar. 1, 2018

(30) Foreign Application Priority Data

Aug. 31, 2016 (JP) ..... 2016-170029
Jul. 3, 2017 (JP) ..... 2017-130565
Aug. 1, 2017 (JP) ..... 2017-149392

(51) Int. Cl.
*G03G 15/16* (2006.01)

(52) U.S. Cl.
CPC ..... *G03G 15/1605* (2013.01); *G03G 15/1615* (2013.01)

(58) Field of Classification Search
CPC ..... G03G 15/1605
See application file for complete search history.

(56) References Cited

U.S. PATENT DOCUMENTS 5,515,145 A * 5/1996 Sasaki ..... G03G 15/0131 347/153
5,875,380 A 2/1999 Iwata et al.
(Continued)

FOREIGN PATENT DOCUMENTS

JP 10-288898 10/1998
JP 2011-164501 8/2011
(Continued)

OTHER PUBLICATIONS

U.S. Appl. No. 15/596,365, filed May 18, 2017.

*Primary Examiner* — Clayton E Laballe
*Assistant Examiner* — Jas Sanghera
(74) *Attorney, Agent, or Firm* — Oblon, McClelland, Maier & Neustadt, L.L.P.

(57) ABSTRACT

An image forming apparatus includes an image bearer, an intermediate transferor, a secondary transferor, a plurality of rotators including a secondary driving rotator, and a detector. The image bearer bears a detection image. The detection image is transferred from the image bearer to the intermediate transferor at a primary transfer position. The secondary transferor is looped around the plurality of rotators and disposed in contact with the intermediate transferor at a secondary transfer position where the detection image is transferred from the intermediate transferor to the secondary transferor. The secondary driving rotator drives the secondary transferor. The detector detects the detection image on the secondary transferor at a detection position. With this configuration, a distance from the secondary transfer position to the detection position on the secondary transferor is an integral multiple of a circumference of the secondary driving rotator.

18 Claims, 9 Drawing Sheets

(56) References Cited

U.S. PATENT DOCUMENTS

| | | | | |
|---|---|---|---|---|
| 2004/0101332 | A1* | 5/2004 | Sohmiya | G03G 15/1625 399/307 |
| 2005/0105937 | A1* | 5/2005 | Sakai | G03G 15/0131 399/301 |
| 2010/0142985 | A1 | 6/2010 | Minbe et al. | |
| 2010/0303495 | A1* | 12/2010 | Kurosu | G03G 15/2064 399/68 |
| 2011/0013950 | A1* | 1/2011 | Furuya | G03G 15/167 399/302 |
| 2011/0158677 | A1 | 6/2011 | Kikuchi et al. | |
| 2011/0206399 | A1 | 8/2011 | Fujita et al. | |
| 2011/0206423 | A1* | 8/2011 | Sugita | G03G 15/0131 399/308 |
| 2011/0211855 | A1 | 9/2011 | Kogure et al. | |
| 2011/0222882 | A1* | 9/2011 | Sugiyama | G03G 15/0131 399/49 |
| 2011/0222885 | A1* | 9/2011 | Yamaki | G03G 15/0131 399/66 |
| 2011/0255909 | A1* | 10/2011 | Tomura | G03G 15/0131 399/308 |
| 2012/0224870 | A1 | 9/2012 | Kikuchi et al. | |
| 2012/0315058 | A1 | 12/2012 | Shimizu et al. | |
| 2013/0051828 | A1 | 2/2013 | Yogosawa et al. | |
| 2013/0216260 | A1 | 8/2013 | Kogure et al. | |
| 2013/0315617 | A1 | 11/2013 | Sugiura et al. | |
| 2014/0072340 | A1 | 3/2014 | Kato et al. | |
| 2014/0241744 | A1 | 8/2014 | Ichikawa et al. | |
| 2014/0314461 | A1 | 10/2014 | Ishizuka et al. | |
| 2015/0037054 | A1 | 2/2015 | Nagata et al. | |
| 2015/0212454 | A1 | 7/2015 | Ichikawa et al. | |
| 2016/0033915 | A1 | 2/2016 | Kumagai et al. | |
| 2016/0041508 | A1 | 2/2016 | Kogure et al. | |

FOREIGN PATENT DOCUMENTS

| | | |
|---|---|---|
| JP | 2013-117619 | 6/2013 |
| JP | 2016-206395 | 12/2016 |

* cited by examiner

IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2016-170029, filed on Aug. 31, 2016, 2017-130565, filed on Jul. 3, 2017, and 2017-149392, filed on Aug. 1, 2017 in the Japan Patent Office, the entire disclosure of each of which is hereby incorporated by reference herein.

BACKGROUND

Technical Field

Aspects of the present disclosure relate to an image forming apparatus.

Related Art

There is an image forming apparatus that adjusts color shift or misalignment in color superimposition, using the following technique. A toner pattern for detection is formed on an image bearer. The toner pattern is transferred onto a secondary transferor via an intermediate transferor that contacts the image bearer. Then the toner pattern on the secondary transferor is detected by a sensor, and an image forming device is controlled according to the detected result to adjust the color shift or the misalignment.

SUMMARY

According to embodiments of this disclosure, an improved image forming apparatus includes an image bearer, an intermediate transferor, a secondary transferor, a plurality of rotators including a secondary driving rotator, and a detector. The image bearer bears a detection image. The detection image is transferred from the image bearer to the intermediate transferor at a primary transfer position. The secondary transferor is looped around the plurality of rotators and disposed in contact with the intermediate transferor at a secondary transfer position where the detection image is transferred from the intermediate transferor to the secondary transferor. The secondary driving rotator drives the secondary transferor. The detector detects the detection image on the secondary transferor at a detection position. With this configuration, a distance from the secondary transfer position to the detection position on the secondary transferor is an integral multiple of a circumference of the secondary driving rotator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
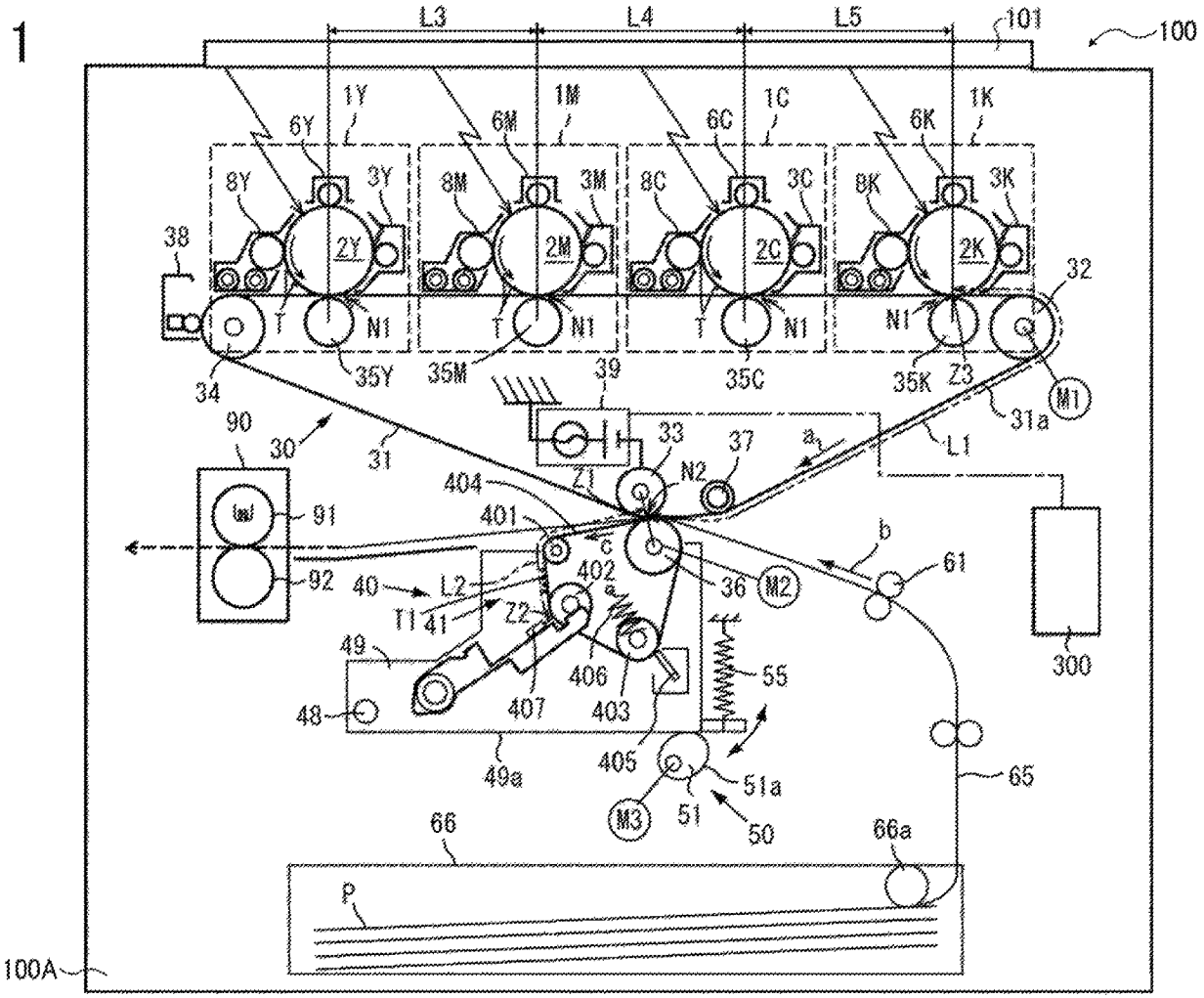
FIG. 1 is a schematic view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner and achieve a similar result.

Referring now to the drawings, wherein like reference numerals designate identical or corresponding parts throughout the several views thereof, and particularly to FIG. 1, an image forming apparatus according to embodiments of the present disclosure is described. Redundant descriptions thereof may be omitted. Components in the drawings may be partially omitted to facilitate understanding of the configurations. As used herein, the singular forms "a", "an", and "the" are intended to include the plural forms as well, unless the context clearly indicates otherwise.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

With reference to FIG. 1, a description is provided of an electrophotographic color printer as an example of an image forming apparatus 100 according to an illustrative embodiment of the present disclosure.

A basic configuration of the image forming apparatus 100, which in the present embodiment is a printer, is described below. FIG. 1 is a schematic view of the image forming apparatus 100 according to an embodiment of the present disclosure. As illustrated in FIG. 1, the image forming apparatus 100 includes four image forming units 1Y, 1M, 1C, and 1K to form toner images of yellow, magenta, cyan, and black, respectively. It is to be noted that the suffixes Y, M, C, and K denote colors of yellow, magenta, cyan, and black, respectively. To simplify the description, the suffixes Y, M, C, and K indicating colors may be omitted herein, unless differentiation of colors is necessary. The image forming apparatus 100 includes an intermediate transfer unit 30 serving as a transfer device, a secondary transfer unit 41 serving as a secondary transfer device, a media tray 66 to store recording media P, a fixing device 90, and a controller 300.

The four image forming units 1Y, 1M, 1C, and 1K all have the same configuration as all the others, differing only in the color of toner employed as a powder-form developer. The image forming units 1Y, 1M, 1C, and 1K are replaced upon reaching their product life cycles. According to the embodiment, the four image forming units 1Y, 1M, 1C, and 1K are detachably attachable relative to an apparatus body 100A of the image forming apparatus 100 to be replaceable. The four image forming units 1Y, 1M, 1C, and 1K are disposed adjacently.

The image forming unit 1 includes a drum-shaped photoconductor 2 serving as an image bearer, a photoconductor cleaner 3, a static eliminator, a charging device 6, a developing device 8, and so forth. The components of the image forming unit 1 are held in a common casing and construct a process cartridge mountable and removable in and from the apparatus body 100A. That is, the components of the image forming unit 1 are replaceable at a time.

The photoconductor 2 is rotated in a counterclockwise direction by a driver such as a motor. The charging device 6 includes a charging roller serving as a charge member to which a charging bias is applied. The charging roller contacts or approaches the photoconductor 2 to generate an electrical discharge therebetween, thereby charging uniformly the surface of the photoconductor 2. According to the first embodiment, the photoconductor 2 is charged by the charging roller contacting the photoconductor 2 or disposed near the photoconductor 2. Alternatively, a corona charger may be employed.

The surface of the photoconductor 2, uniformly charged by the charging device 6, is scanned by exposure light such as a laser beam from an optical writing unit 101 disposed above the image forming units 1. Thus, an electrostatic latent image of yellow, magenta, cyan, or black is formed on the surface of the photoconductor 2. The electrostatic latent image on the photoconductor 2 is developed with toner of the respective color by the developing device 8. Accordingly, a visible image, also known as a toner image T, is formed. Thus, the toner image T is formed on the photoconductor 2. The toner image T formed on the photoconductor 2 is transferred primarily onto a front surface 31*a* of an intermediate transfer belt 31 serving as an intermediate transferor formed into an endless loop.

The photoconductor cleaner 3 removes residual toner remaining on the surface of the photoconductor 2 after a primary transfer process, that is, after the photoconductor 2 passes through a primary transfer nip between the intermediate transfer belt 31 and the photoconductor 2. The static eliminator may employ a known static eliminating device and removes residual charge remaining on the photoconductor 2 after the surface thereof is cleaned by the photoconductor cleaner 3 in preparation for the subsequent imaging cycle. The surface of the photoconductor 2 is initialized by the charge removing operation in preparation for the subsequent imaging cycle.

The intermediate transfer unit 30 serving as a belt unit and a primary transfer device is disposed substantially below the image forming units 1Y, 1M, 1C, and 1K. The intermediate transfer unit 30 includes the intermediate transfer belt 31 serving as an intermediate transferor formed into an endless loop and rotated in the clockwise direction. For convenience, the intermediate transfer unit 30 may be referred to as a primary transfer unit as well as the intermediate transfer unit. A direction of rotary movement of the intermediate transfer belt 31 is referred to as a belt direction of travel as indicated by arrow a in FIG. 1.

The intermediate transfer unit 30 is detachably attachable (replaceable) relative to the apparatus body 100A. Besides the intermediate transfer belt 31 serving as the belt-shaped image bearer and the intermediate transferor, the intermediate transfer unit 30 further includes a plurality of rotators: a drive roller 32, a secondary-transfer backside roller 33, a cleaning auxiliary roller 34, four primary transfer rollers 35Y, 35M, 35C, and 35K, and a pre-transfer roller 37. The drive roller 32 rotated by a primary drive motor M1 serves as an intermediate driving rotator.

The intermediate transfer belt 31 is looped around and stretched taut between the plurality of rotators, i.e., the drive roller 32, the secondary-transfer backside roller 33, the cleaning auxiliary roller 34, the four primary transfer rollers 35Y, 35M, 35C, and 35K, and the pre-transfer rollers 37. As the drive roller 32 rotates clockwise in FIG. 1, driven by a driver such as the primary drive motor M1, the intermediate transfer belt 31 rotates endlessly in the same direction. In the present embodiment, the intermediate transfer belt 31 is an endless elastic belt constructed of a plurality of layers. The intermediate transfer belt 31 serves as the intermediate transferor onto which the toner images are transferred from the photoconductors 2Y, 2M, 2C, and 2K.

The intermediate transfer belt 31 is interposed between the primary transfer rollers 35Y, 35M, 35C, and 35K, and the photoconductors 2Y, 2M, 2C, and 2K, thereby forming primary transfer nips N1 serving as primary transfer areas for each color between a front surface 31*a* or an image bearing face of the intermediate transfer belt 31 and a surface of the photoconductors 2Y, 2M, 2C, and 2K. A primary transfer bias is applied to the primary transfer rollers 35Y, 35M, 35C, and 35K by a transfer bias power source. Accordingly, a primary transfer electric field is formed between the primary transfer rollers 35Y, 35M, 35C, and 35K, and the toner images of yellow, magenta, cyan, and black formed on the photoconductors 2Y, 2M, 2C, and 2K.

A yellow toner image formed on the photoconductor 2Y enters the primary transfer nip N1 for yellow as the photoconductor 2Y rotates. Subsequently, the yellow toner image is primarily transferred from the photoconductor 2Y to the intermediate transfer belt 31 by the primary transfer electric field and a nip pressure. The intermediate transfer belt 31, on which the yellow toner image has been transferred, passes through the primary transfer nips N1 of magenta, cyan, and black. Subsequently, a magenta toner image, a cyan toner image, and a black toner image on the photoconductors 2M, 2C, and 2K, respectively, are superimposed on the yellow toner image which has been transferred on the intermediate transfer belt 31, one atop the other in the primary transfer process. Accordingly, a composite toner image, in which the toner images of four different colors are superimposed on one atop the other, is formed on the surface of the intermediate transfer belt 31 in the primary transfer process.

Although the description above concerns full-color image formation. However, the image forming apparatus 100 may form a single-color image with one of yellow, magenta, cyan, and black toner and may transfer the single-color image to the intermediate transfer belt 31. Alternatively, the image forming apparatus 100 may form a multi-color image with at least two of yellow, magenta, cyan, and black toner and may transfer the multi-color image to the intermediate transfer belt 31.

A secondary transfer device 40 is disposed below the loop formed by the intermediate transfer belt 31. The secondary transfer device 40 includes a secondary transfer unit 41 with a secondary transfer belt 404 made of harder resin material than the intermediate transfer belt 31, for example, polyimide (PI). The secondary transfer belt 404 serves as and a secondary transferor. The secondary transfer unit 41 nips the intermediate transfer belt 31 between the secondary-transfer backside roller 33 disposed inside the loop of the intermediate transfer belt 31. The contact portion between the front surface 31*a* of the intermediate transfer belt 31 and the secondary transfer belt 404 is referred to as a secondary transfer nip N2.

In the present embodiment, a power source 39 as a transfer bias power source applies a secondary transfer bias to the secondary-transfer backside roller 33. Accordingly, a secondary transfer electric field is generated between the secondary-transfer backside roller 33 and the secondary transfer belt 404. The secondary transfer electric field electrostatically moves the toner, which has a negative polarity, from the secondary-transfer backside roller 33 toward the secondary transfer belt 404. In the present embodiment, the toner image T on the intermediate transfer belt 31 is transferred onto the recording medium P in the secondary transfer nip N2 serving as a secondary transfer position. The intermediate transfer belt 31 is an image bearer that forms the secondary transfer nip N2 together with the secondary transfer belt 404 that is a conveyor belt. The intermediate transfer belt 31 also serves as the intermediate transferor onto which the toner images are transferred primarily from the photoconductors 2Y, 2M, 2C, and 2K. The toner image transferred onto the secondary transfer belt 404 is a test pattern image (register mark) T1 used to detect image density, color shift, or misalignment.

In the present embodiment, the power source 39 applies the bias for secondary transfer (secondary transfer bias) to the secondary-transfer backside roller 33. The secondary transfer bias is a direct current (DC) voltage overlapped with an alternating current (AC) voltage and has a negative polarity of the voltage on a time average (time average voltage). The secondary transfer bias, which has the negative polarity of the voltage on a time average, is applied to the secondary-transfer backside roller 33. The negatively charged toner is given a repulsive force by the secondary transfer bias. The secondary-transfer backside roller 33 is referred to as a repulsive force roller.

In this embodiment, the power source 39 applies the bias for secondary transfer (secondary transfer bias) to the secondary-transfer backside roller 33. In some embodiments, the power source 39 applies secondary transfer bias to the secondary transfer roller 36 opposite to the secondary-transfer backside roller 33. In a case in which the secondary transfer bias is applied to the secondary transfer roller 36, the secondary transfer bias having an opposite polarity of the toner is applied thereto. In a case in which the secondary transfer bias is applied to the secondary-transfer backside roller 33, the secondary transfer bias having the same polarity as that of the toner is applied thereto. The secondary transfer roller 36 is also referred to as a nip forming roller.

The secondary transfer bias is a DC voltage overlapped with AC voltage. Alternatively, the secondary transfer bias may be DC bias alone.

As illustrated in FIG. 1, the media tray 66 to store a bundle of recording media P, such as paper sheets or resin sheets, is disposed below the secondary transfer device 40. The media tray 66 is equipped with a feed roller 66*a* to contact a topmost one of recording media P in the media tray 66. The feed roller 66*a* is rotated at predetermined timing to pick up and send the topmost one of the recording media P from the media tray 66 to a conveyance path 65 toward the secondary transfer nip N2. Then, a registration roller pair 61 forwards the recording medium P in the conveyance path 65 to the secondary transfer nip N2, so that the recording medium P coincides with the toner image on the front surface 31*a* of the intermediate transfer belt 31 in the secondary transfer nip N2. The recording medium P is an object to be conveyed.

In the secondary transfer nip N2, the toner image on the front surface 31*a* of the intermediate transfer belt 31 is collectively transferred onto the recording medium P by the secondary transfer electric field and a nip pressure applied thereto, thereby forming a full-color toner image in combination with white color of the recording medium P. After passage of the secondary transfer nip N2, residual toner remains on the front surface 31*a* of the intermediate transfer belt 31. The residual toner is removed from the intermediate transfer belt 31 by the intermediate transfer belt cleaning device 38 which contacts the front surface 31*a* of the intermediate transfer belt 31.

The fixing device 90 is disposed downstream from the secondary transfer nip N2 in a conveyance direction b of the recording medium P. The recording medium P having the toner image transferred thereon is delivered into the fixing device 90. The fixing device 90 includes a fixing roller 91 including a heat source inside thereof and a pressure roller 92. The fixing roller 91 and the pressure roller 92 contact to form a fixing nip where heat and pressure are applied. The composite toner image is softened and fixed on the recording medium P as the recording medium P passes through the fixing nip. After the toner image is fixed on the recording medium P, the recording medium P is delivered from the fixing device 90. Subsequently, the recording medium P is ejected outside the apparatus body 100A.

The image forming apparatus 100 of the present embodiment has an image adjustment mode to adjust the image density, the color shift, or the misalignment. When the image adjustment mode is set, an image formation signal is generated, and the test pattern images (register mark) T1 are developed outside image areas on the photo-conductors 2Y, 2M, 2C, and 2K as respective color toner images to be detected for correction of the color shift or the misalignment. The test pattern images T1 are primarily transferred onto the intermediate transfer belt 31 in the primary transfer nip N1 and then transferred not onto a recording medium P but onto a front surface 404*a* of the secondary transfer belt 404 in the secondary transfer nip N2. In the image adjustment mode, a pattern detector 407 serving as a detector detects a position of the test pattern image T1 transferred onto the front surface 404*a* of the secondary transfer belt 404. In the image adjustment mode, in accordance with position data detected by the pattern detector 407, the controller 300 carries out feed-back control such that the position of the test pattern image T1 is at a predetermined position. More specifically, in accordance with the position data detected by the pattern detector 407, the controller 300 adjusts image formation positions of the electrostatic latent images for respective colors on the photoconductors 2Y, 2M, 2C, and 2K such that the position of the test pattern image T1 is at a predetermined position. Accordingly, the color shift for each color is prevented.

Next, a configuration of the secondary transfer unit 41 is described below.

Figure 2:
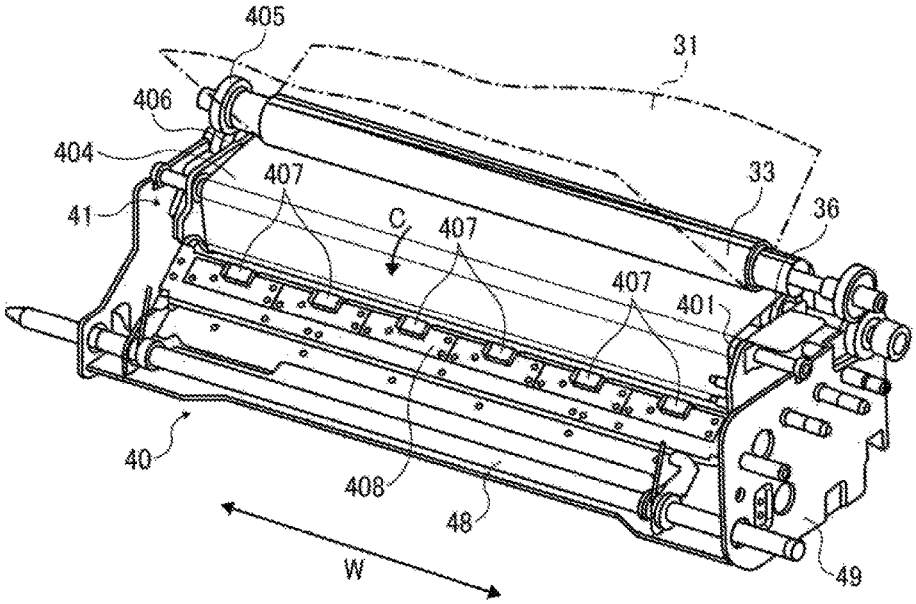
FIG. 2 is a perspective view of a secondary transfer unit in the image forming apparatus illustrated in FIG. 1.

As illustrated in FIGS. 1 and 2, a pressing frame 49 detachably supports the secondary transfer unit 41. The secondary transfer unit 41 is replaceable independently as a single unit. The secondary transfer unit 41 includes the secondary transfer roller 36 serving as a secondary driving rotator and a transfer nip forming member disposed opposite to the secondary-transfer backside roller 33 via the intermediate transfer belt 31. The secondary transfer unit 41 includes three rollers 401, 402, and 403 serving as three rotators, the secondary transfer roller 36, the secondary transfer belt 404, and a cleaning blade 405 serving as a belt cleaning member. In the embodiment, the cleaning blade 405 constitutes a cleaning section. The secondary transfer unit 41 is an a belt conveyor unit in which the secondary transfer belt 404 is an endless looped belt serving as an image bearer and is looped around the plurality of rotators, i.e., the secondary transfer roller 36 and the rollers 401, 402, and 403. The secondary transfer roller 36 is also referred to as a nip forming roller.

The secondary transfer roller 36, which is grounded, secondarily transfers the toner image T from the front surface 31*a* of the intermediate transfer belt 31 onto the recording medium P. The secondary transfer roller 36 is disposed inside the belt loop of the secondary transfer belt 404 and opposite to the secondary-transfer backside roller 33. The intermediate transfer belt 31 and the secondary transfer belt 404 are interposed between the secondary transfer roller 36 and the secondary-transfer backside roller 33. The secondary transfer roller 36 is pressed against the secondary transfer belt 404 so as to pressingly contact the secondary transfer belt 404, thereby forming the secondary transfer nip N2 between the intermediate transfer belt 31 and the secondary transfer belt 404.

The secondary transfer belt 404 can be a belt made of resin such as polyimide (PI), polyamide imide (PAI), and polyvinylidene fluoride (PVDF). The secondary transfer belt 404 can be a belt made of an elastic material.

The roller 401 acts to strip the recording medium P, which is electrostatically attracted to the secondary transfer belt 404, from the secondary transfer belt 404 by self stripping along the curvature of the roller 401. The roller 403 serves as a tension rotator that presses the secondary transfer belt 404 from the inside of the loop of the secondary transfer belt 404 towards the outside by a tension spring 406 as a biasing member.

The secondary transfer roller 36 is rotated counterclockwise by a secondary drive motor M2 serving as a driver to drive the secondary transfer belt 404 independently of the intermediate transfer belt 31. According to the present embodiment, the place where the secondary transfer belt 404 contacts the intermediate transfer belt 31 is a so-called secondary transfer nip N2. That is, the image forming apparatus 100 includes a belt type secondary transfer area. An arrow c indicates a direction of travel of the secondary transfer belt 404.

A tip of the cleaning blade 405 contacts the front surface 404*a* of the secondary transfer belt 404 at the position opposite the roller 403. The cleaning blade 405 is disposed downstream of the pattern detector 407 in the direction of travel c of the secondary transfer belt 404. The cleaning blade 405 forms the cleaning section to remove the test pattern image T1 on the secondary transfer belt 404 after detection by the pattern detector 407.

The secondary transfer unit 41 includes the pattern detector 407 disposed outside of the secondary transfer belt 404 opposed to the roller 402. The pattern detector 407 detects the position of the test pattern image T1 that is the toner image for image position correction transferred onto the front surface 404*a* of the secondary transfer belt 404 via the intermediate transfer belt 31. Then, the pattern detector 407 outputs the detected result.

As illustrated in FIG. 2, the pattern detector 407 is supported by a detector supporter 408 having an elongated shape in a width direction W of the secondary transfer belt 404, and a plurality of pattern detectors 407 is disposed in the width direction W. In the present embodiment, the number of the pattern detectors 407 is six, and the six pattern detectors 407 are disposed at a distance from an area where the test pattern image T1 is formed. The plurality of pattern detectors 407 is disposed downstream from the secondary transfer nip N2 in the direction of travel c of the secondary transfer belt 404 and opposite to the front surface 404*a* of the secondary transfer belt 404 with a certain gap therebetween.

In the present embodiment, the test pattern image T1 is transferred onto the secondary transfer belt 404 via the primary transfer nip N1 and the secondary transfer nip N2 to detect the test pattern image T1 on the secondary transfer belt 404 by the pattern detector 407. Then, the test pattern image T1 is conveyed to a detection position Z2.

In consideration of a transfer efficiency, the elastic belt is used as the intermediate transfer belt 31 in the present embodiment. The intermediate transfer belt 31 is driven by the drive roller 32 as the intermediate driving rotator. Therefore, the intermediate transfer belt 31 moves at speed with periodical fluctuation, that is, not at strictly constant speed, due to eccentricity of a surface of the drive roller 32 with respect to a rotation axis or that of rotary transmitter such as a gear to transmit rotational force. In the same manner, the secondary transfer belt 404 moves at speed with periodical fluctuation due to eccentricity of a surface of the secondary transfer roller 36 with respect to a rotation axis or that of rotary transmission parts to transmit rotational force such as a gear attached to a shaft of the secondary transfer roller 36.

As the pattern image T1 is transferred from each photoconductor 2Y, 2M, 2C, and 2K onto the intermediate transfer belt 31 in the primary transfer nip N1 and transferred onto the secondary transfer belt 404 in the secondary transfer nip N2, the pattern image T1 may be formed at a position shifted from an original position due to speed fluctuation of conveyance of intermediate transfer belt 31 or the secondary transfer belt 404. In addition, the test pattern image T1 may be detected at a position shifted from an original position due to speed fluctuation of conveyance. For this reason, a detection of the amount of shift between superimposed colors may be not accurate.

Accordingly in the present embodiment, the test pattern image T1 is detected accurately to increase the accuracy with which the amount of shift between superimposed colors is detected.

First Embodiment

Figure 4:
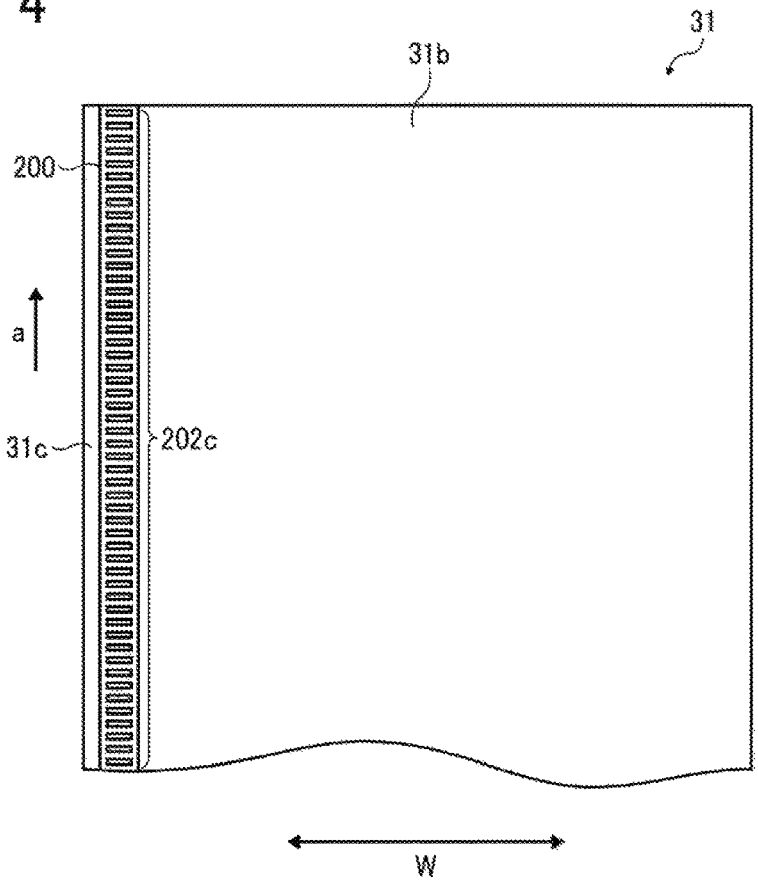
FIG. 4 is an enlarged schematic view illustrating an example configuration of a tape-shaped detected portion disposed on a back side of an intermediate transferor.

In the first embodiment, as illustrated in FIG. 1, the image forming apparatus 100 includes a transfer pressure adjuster 50 configured to adjust a transfer pressure acting on the secondary transfer nip N2 and employs the intermediate transfer belt 31 with a scale tape 200 as illustrated in FIG. 4. A scale detector 60 detects the scale tape 200, and a primary drive motor M1 to rotate the drive roller 32 is controlled to stabilize a traveling speed of the intermediate transfer belt 31.

In the present embodiment, as illustrated in FIG. 4, the scale tape 200 is disposed along the entire circumference of a back surface 31*b* of the intermediate transfer belt 31 facing each roller. The scale tape 200 is disposed at least one of both ends 31*c* of the intermediate transfer belt 31 in the width direction W of the intermediate transfer belt 31, which is an axial direction of the roller and crosses with the belt direction of travel a.

Figure 5:
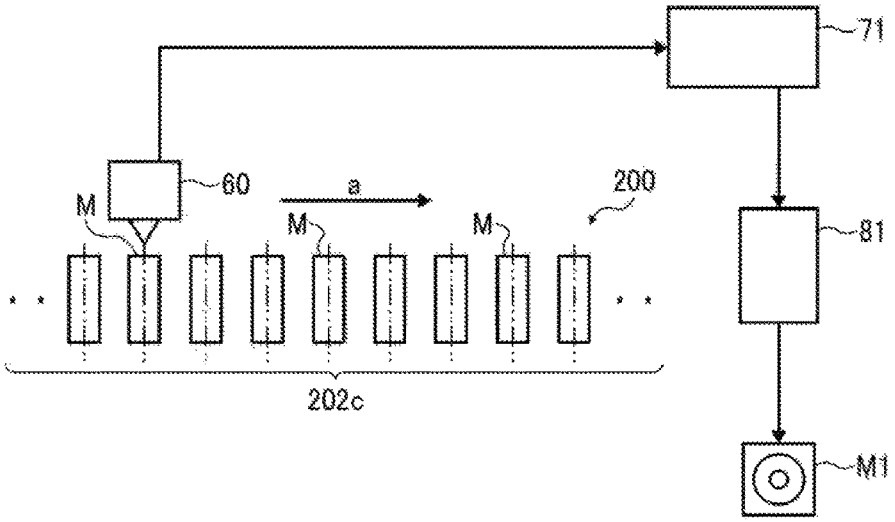
FIG. 5 is a schematic diagram illustrating an arrangement and a configuration of an optical detector configured to detect the tape-shaped detected portion.
Figure 6A:
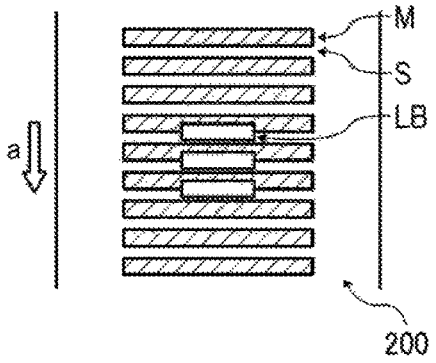
FIGS. 6A, 6B, and 6C are schematic diagrams illustrating the configuration of the optical detector.

An uneven portion 202*c* including projections and recesses that are arranged alternately is formed on the scale tape 200. The projections are referred to as scale marks M. Alternatively, the recesses can be scale marks M. As illustrated in FIGS. 5 and 6A, each of scale marks M in the uneven portion 202*c* has the same length. The scale marks M are parallel with each other and equally spaced. The scale marks M are arranged with very small pitches along the entire circumference of the intermediate transfer belt 31 in the belt direction of travel a of the intermediate transfer belt 31. The scale marks M as a whole constitute a detected portion of the intermediate transfer belt 31.

In the present embodiment, the scale tape 200 is formed along the entire circumference of the intermediate transfer belt 31. Otherwise, the scale tape 200 can be formed along a part of the circumference of the intermediate transfer belt 31 in the direction of travel.

Figure 6B:
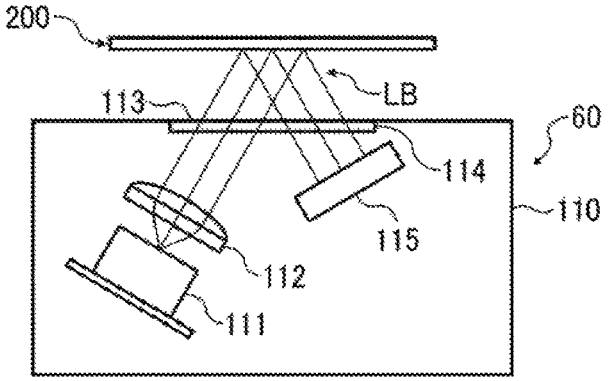

A scale detector 60 to detect the scale marks M is disposed opposite to the scale marks M as illustrated in FIGS. 6A and 6B. The scale detector 60 is connected to a drive controller 71 via a signal line. The scale detector 60 detects sequentially the scale marks M on the intermediate transfer belt 31 and output detection signals to the drive controller 71. In other words, the scale detector 60 detects the scale tape 200 serving as the detected portion. The drive controller 71 is connected to the primary drive motor M1 via motor drive circuitry 81 and controls the primary drive motor M1 to control the traveling speed of the intermediate transfer belt 31. Based on the detection signals from the scale detector 60, the drive controller 71 obtains position data and so forth to calibrate the pitch of the scale marks M, and inputs a target position data and so forth to the motor drive circuitry 81. Accordingly, the traveling speed of the intermediate transfer belt 31 is adjusted. Based on the position data of the intermediate transfer belt 31 detected by the scale detector 60, the drive controller 71 outputs signals to the motor drive circuitry 81 as needed, thereby enabling the motor drive circuitry 81 to drive the primary drive motor M1. Accordingly, the traveling speed of the intermediate transfer belt 31 is feedback-controlled.

Figure 6C:
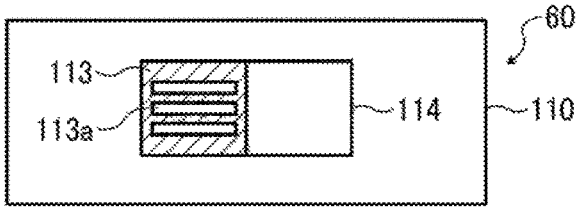

Referring to FIGS. 6A through 6C, descriptions are given below of detection of the scale mark M by the scale detector 60. FIG. 6A is a schematic plan view illustrating the scale marks M on the scale tape. FIG. 6B is a perspective side view illustrating an optical configuration and light path of the scale detector 60. FIG. 6C is a schematic plain view illustrating a detecting face of the scale detector 60. The scale marks M are reflective. As illustrated in FIG. 6A, a reflective portion, that is, the scale mark M, and a shield portion S are alternately formed along the belt direction of travel a on the back surface 31*b* of the intermediate transfer belt 31.

As illustrated in FIGS. 6B and 6C, the scale detector 60 includes a light emitting element 111 such as a light emitting diode (LED), a collimator lens 112, a slit mask 113, a light receiving window 114, and a light receiving element 115 such as a phototransistor. These devices are secured to a detector housing 110. The light receiving window 114 is formed of a transparent cover such as a glass and a transparent resin film.

As the light emitting element 111 serving as a light source of the scale detector 60 emits light, the light passes through the collimator lens 112 and becomes parallel rays of light. Then, as illustrated in FIG. 6C, the light passes through a plurality of slits 113*a* of the slit mask 113 parallel with the scale marks M, splitting into a plurality of light beams LB which then irradiate the scale tape 200 on the intermediate transfer belt 31. A portion of the plurality of light beams LB is reflected by the scale marks M. The reflected light passes through the light receiving window 114, and is received by the light receiving element 115. The light receiving element 115 then converts changes in the brightness (intensity) of the reflected light into electrical signals. As described above, the light receiving element 115 detects the intensity of the reflected light to detect the scale marks M. The scale detector 60 converts the presence of the scale marks M as the intermediate transfer belt 31 travels into a continuously-modulated analog alternating signal.

Based on the detection result detected by the scale detector 60, the primary drive motor M1 is feed-back controlled to minimize the speed fluctuation of the intermediate transfer belt 31 and stabilize the speed of the intermediate transfer belt 31.

The secondary transfer device 40 is attached to a pressing frame 49. The pressing frame 49 is hinged to the apparatus body 100A with a support shaft 48. Accordingly, the secondary transfer device 40 and the pressing frame 49 can swing together. The pressing frame 49 presses the secondary transfer belt 404 in a direction to contact the intermediate transfer belt 31 by a tension coil spring 55 serving as a pressure spring. Thus, the secondary transfer belt 404 is pressed against the intermediate transfer belt 31.

The transfer pressure adjuster 50 includes a cam 51 and a cam drive motor M3 serving as a driver to rotate the cam 51. The cam 51 is an eccentric cam and disposed below the pressing frame 49. Outer circumferential faces 51*a* of the cam 51 contact a lower portion 49*a* of the pressing frame 49. The cam 51 is rotated by the cam drive motor M3. As the pressing frame 49 is swung by the cam 51, the transfer pressure at the secondary transfer nip N2 is adjusted. For example, when the recording medium P is a thin paper sheet, the cam 51 keeps home position as illustrated in FIG. 1. When the recording medium P is a thick paper sheet, the cam 51 is rotated counterclockwise and the pressing frame 49 is swung counterclockwise to raise transfer pressure. Accordingly, the secondary transfer device 40 is lifted to raise transfer pressure by controlling a cam drive motor M3 with the controller 300.

The secondary transfer belt 404 is looped around the rollers 401, 402, and 403 and the secondary transfer roller 36 serving as the plurality of rotators. The secondary transfer roller 36 and the rollers 401, 402, and 403 are arranged in this order with reference to the secondary transfer roller 36 forming the secondary transfer nip N2 in a direction of travel c of the secondary transfer belt 404. The pressing frame 49 serving as a common support frame supports the rollers 401, 402, 403, and the secondary transfer roller 36.

The secondary transfer roller 36 rotated via a drive transmitter by a secondary drive motor M2 is the secondary driving rotator. The secondary transfer nip N2 is disposed opposite to the secondary transfer roller 36 serving as the secondary driving rotator and is formed between the secondary transfer roller 36 and the secondary-transfer backside roller 33 serving as a rotator around which the intermediate transfer belt 31 is looped. As the secondary drive motor M2 rotates, the secondary transfer belt 404 rotates counterclockwise in FIG. 1. The roller 403 serves as a tension rotator and presses the secondary transfer belt 404 from inside the loop to the outside.

In the present embodiment, a hardness of a surface of the secondary transfer roller 36 in accordance with Japanese Industrial Standards (JIS-A) is greater than that of a surface of the secondary-transfer backside roller 33. The secondary-transfer backside roller 33 serves as an opposed rotator of the secondary transfer roller 36. In the present embodiment, the hardness of the surface of the secondary transfer roller 36 as the secondary driving rotator is 70 degrees (JIS-A), and that of the surface of the secondary-transfer backside roller 33 as the opposed rotator is 45 degrees (JIS-A).

The roller 401 is disposed between the secondary transfer roller 36 and the roller 402. The roller 401 serves as a separation roller to separate the recording medium P, which is conveyed with the secondary transfer belt 404 traveling through the secondary transfer nip N2, from the secondary transfer belt 404 by self stripping along the curvature of the roller 401.

The roller 402 is one of the plurality rotators around which the secondary transfer belt 404 is looped. The roller 402 is a detection rotator opposite the pattern detector 407 via the secondary transfer belt 404.

The roller 401 is another one of the plurality rotators and is disposed between the secondary transfer nip N2 and the roller 402 serving as a detection rotator. The roller 401 is a support rotator that is a metal roller without an elastic layer.

In the image forming apparatus 100 having such a configuration, the pattern detector 407 as the detector is disposed opposite to the roller 402. The pattern detector 407 irradiates the surface of a portion of the secondary transfer belt 404 facing the roller 402 with a detection light. In the present embodiment, a position of the secondary transfer belt 404 irradiated with the detection light is referred to as a detection position Z2 by the pattern detector 407 on the secondary transfer belt 404.

In the present embodiment, the detection position Z2 by the pattern detector 407 is disposed between the secondary transfer nip N2 and the roller 403 serving as the tension rotator in the direction of travel c of the secondary transfer belt 404.

Figure 3:
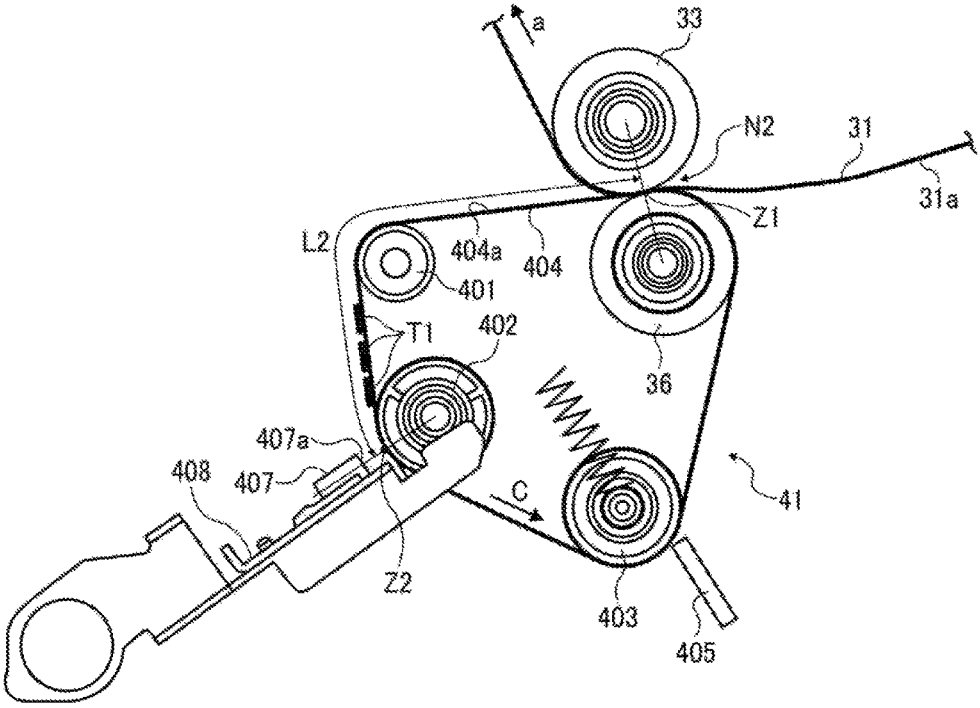
FIG. 3 is a side view of a secondary transfer unit in the image forming apparatus illustrated in FIG. 1.

Next, a distance between positions will be described with reference to FIGS. 1 and 3. FIG. 3 is a side view of the secondary transfer unit in the image forming apparatus in FIG. 1. In FIG. 3, an area from a secondary transfer position Z1 to the detection position Z2 in FIG. 1 is enlarged.

In the present embodiment, the distance from the secondary transfer position to the detection position by the detector on the secondary transferor is a distance L2 on the secondary transfer belt 404 from a center position Z1 (secondary transfer position) of the secondary transfer nip N2 to the detection position Z2 by the pattern detector 407.

A distance from a primary transfer position to the secondary transfer position is a distance L1 on the intermediate transfer belt 31 from a center position Z3 (primary transfer position) of the primary transfer nip N2 closest to the drive roller 32 to the center position Z1 of the secondary transfer nip N2. Here, the center position Z3 is a center of the primary transfer nip N1 where a black toner image is transferred. The center position Z3 is a center of a width of the primary transfer nip N1 in the direction of travel a of the intermediate transfer belt 31. The center position Z1 is a center of a width of the secondary transfer nip N2 in the direction of travel a of the intermediate transfer belt 31. Distances between image forming sections are distances L3, L4, and L5 (illustrated in FIG. 1) between a center of the primary transfer nips N1 of the image forming units 1Y, 1M, 1C, and 1K. The primary transfer nip N1 is formed between each image forming unit and the intermediate transfer belt 31. The distances L3, L4, and L5 are identical.

In the image forming apparatus 100 having such a configuration, in a first embodiment, the distance L2 is an integral multiple of a circumference D2π of the secondary transfer roller 36 serving as the secondary driving rotator. Here, a diameter of the secondary transfer roller 36 is referred to as D2.

When the surface position of the secondary transfer roller 36 is eccentric, a peripheral speed of that surface position fluctuates periodically corresponding to the rotation of the secondary transfer roller 36. Accordingly, a traveling speed of the secondary transfer belt 404 driven by the secondary transfer roller 36 periodically fluctuates in response to the rotation of the secondary transfer roller 36.

Figure 7A:
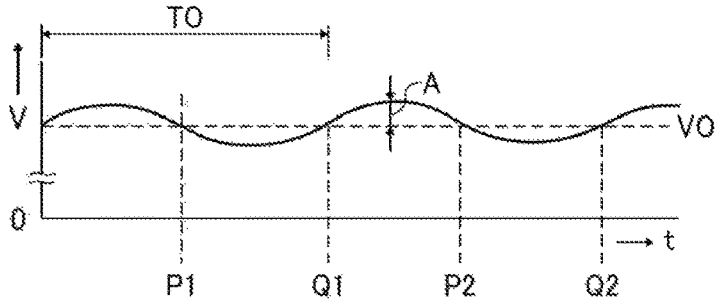
FIGS. 7A and 7B are graphs illustrating a speed fluctuation of a secondary transferor and a misalignment of a detection image.

FIG. 7A illustrates a fluctuation of the traveling speed of the secondary transfer belt 404 based on the eccentricity of the secondary transfer roller 36. The fluctuation of the traveling speed occurs centered around a target traveling speed V0 in a rotation cycle time TO in which the secondary transfer roller 36 rotates once. A speed deviation Yd due to the speed fluctuation, which is a speed difference from the target traveling speed V0, is expressed by the following equation.

$$Vd=A\ \sin(\omega t)$$

where A is an amplitude of the speed fluctuations and ω is an angular speed of the secondary transfer roller 36.

The speed deviation Vd causes a deviation ΔS from a target position on the secondary transfer belt 404, and the color shift occurs during image formation. The deviation ΔS is obtained by integrating the equation described above and is expressed by the following equation.

$$\Delta S=\int_0^t A\ \sin(\omega t)dt=-(A/\omega)\cos\ \omega t$$

Figure 7B:
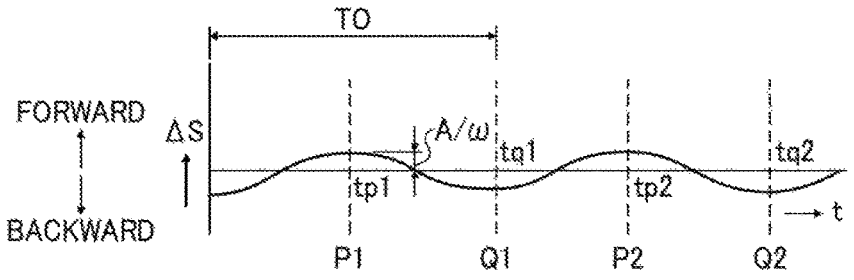

As illustrated in FIG. 7B, the deviation ΔS occurs forward from the target position in a positive area but backward from the target position in a negative area. For example, when the test pattern image T1 is transferred at the position P1 in FIGS. 7A and 7B, the speed deviation Vd is 0 at a time tp1 at which the test pattern image T1 is transferred. However, the test pattern image T1 is transferred in the state in which the secondary transfer belt 404 is located forward from the target position by A/ω due to the positive speed deviation starting before the test pattern image T1 is transferred. Accordingly, the test pattern image T1 is transferred at a position backward from the target position by A/ω. In other words, the transfer of the test pattern image T1 is delayed with respect to a target position. When the test pattern image T1 at a right position on the secondary transfer best 404 is detected at a position P2, the detected signal of the test pattern image T1 is obtained before a target time tp2. Here, the position P2 is downstream from the position P1, and the positions P1 and P2 have the same phases of the deviation ΔS of the secondary transfer belt 404.

Therefore, two positions that have the same phase of the deviation ΔS of the secondary transfer belt 404, such as the position P1 and P2, are selected in order to offset the effect of the speed fluctuation of the secondary transfer belt 404. For example, the test pattern image T1 is transferred at the position P1, and the pattern detector 407 detects the test pattern image T1 at the position P2. Accordingly, advancing the timing of detection compensate for a delay of the image forming position of the test pattern image T1, and the test pattern image T1 can be detected without being affected by the speed fluctuation of the secondary transfer belt 404.

On the other hand, when the test pattern image T1 is transferred at a position Q1 in FIGS. 7A and 7B, the speed deviation Vd is 0 at the time tq1 when the test pattern image T1 is transferred. However, the test pattern image T1 is transferred forward from the target position by A/ω due to the negative speed deviation before. When the test pattern image T1 transferred on the secondary transfer belt 404 is detected at a position Q2, the detected signal is obtained after a target time tq2. Here, the position Q2 is downstream from the position Q1, and the positions Q1 and Q2 have the same phases of the deviation ΔS of the secondary transfer belt 404.

Therefore, two positions that have the same phases of the deviation ΔS of the secondary transfer belt 404, such as the positions Q1 and Q2, are selected in order to offset the effect of the speed fluctuation of the secondary transfer belt 404. For example, the test pattern image T1 is transferred at the position Q1, and the pattern detector 407 detects the test pattern image T1 at the position Q2. Accordingly, delaying the timing of detection compensates for a precedence of the image forming position of the test pattern image T1, and the test pattern image T1 can be detected without being affected by the speed fluctuation of the secondary transfer belt 404.

In the present embodiment, the distance L2 between the detection position Z2 by the pattern detector 407 and the center position Z1 of the secondary transfer nip N2 is an integral multiple of the circumference D2π of the secondary transfer roller 36. Therefore, the misalignments ΔS of the secondary transfer belt 404 due to the eccentricity of the secondary transfer roller 36 are in phases at the detection position Z2 and the secondary transfer position of the test pattern image T1. For this reason, an amount of the color shift can be accurately detected, and the color shift can be adequately corrected without being affected by the speed fluctuation of the secondary transfer belt 404.

Figure 8:
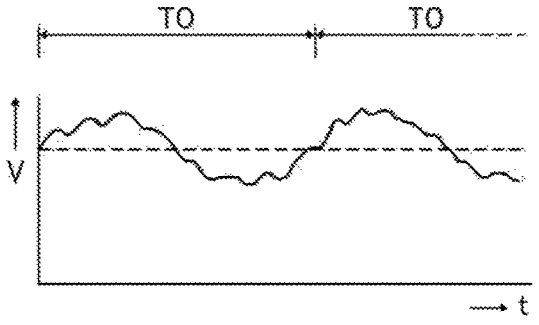
FIG. 8 is a graph illustrating a speed fluctuation of the secondary transferor including an eccentricity of a driving mechanism.

In the present embodiment, the rotation of the secondary drive motor M2 is transmitted to the secondary transfer roller 36 via the drive transmitters such as a motor gear, an intermediate gear, a gear, and a drive roller gear attached to the secondary transfer roller 36. The transmitters have dimension errors such as an eccentricity of a pitch circle. Thus, a short cycle fluctuation due to the dimension error is superimposed on an actual speed fluctuation curve as illustrated in FIG. 8.

In the present embodiment, the secondary drive motor M2 and the drive transmitters such as the motor gear, the intermediate gear, and the gear make integral multiple rotations during one rotation of the secondary transfer roller 36. Accordingly, a plurality of fluctuation cycles due to the superimposed error exists during one rotation of the secondary transfer roller 36. Thus, the unevenness in the second rotation and subsequent rotation is identical to the rotation unevenness in the first rotation. For this reason, an amount of the color shift can be accurately detected, and the color shift can be adequately corrected without being affected by the rotation unevenness of the secondary drive motor M2 that drives the secondary transfer roller 36 and the drive transmitters that transmit driving force to the secondary transfer roller 36.

In the present embodiment, the distance L2 between the detection position Z2 by the pattern detector 407 and the center position Z1 of the secondary transfer nip N2 is the integral multiple of the circumference D2π of the secondary transfer roller 36. In addition, the secondary drive motor M2, the motor gear, the intermediate gear, and the gear make integral multiple rotations during one rotation of the secondary transfer roller 36. Therefore, the misalignments ΔS of the secondary transfer belt 404 due to the eccentricity of the secondary transfer roller 36 are in phase at the detection position Z2 by the pattern detector 407 and the secondary transfer position of the test pattern image T1. For this reason, an amount of the color shift can be accurately detected, and the color shift can be adequately corrected without being affected by the speed fluctuation of the secondary transfer belt 404 and the rotation unevenness of the secondary drive motor M2 to drive the secondary transfer roller 36.

The image forming apparatus in the first embodiment includes the cam 51, the speed of the intermediate transfer belt 31 is feed-back controlled with the scale detector 60, and the hardness of the secondary transfer roller 36 is greater than that of the secondary-transfer backside roller 33 in the secondary transfer nip N2. The cam 51 serves as transfer pressure adjuster 50 to change the transfer pressure at the secondary transfer nip N2. The secondary transfer roller 36 is the support roller of the secondary transfer belt 404, and the secondary-transfer backside roller 33 is the support roller of the intermediate transfer belt 31. Accordingly, the secondary transfer belt 404 is not easily deformed due to the transfer pressure. Even if the transfer pressure fluctuates, the distance L2 does not change easily. That is, the distance L2 is stabilized regardless of the transfer pressure.

In the present embodiment, the roller 401 is disposed between the secondary transfer roller 36 and the roller 402. In other words, the roller 401 is disposed between the secondary transfer nip N2 and the roller 402 serving as the detection rotator. The roller 401 is the metal roller without the elastic layer. Therefore, change of the length of the circumference of the secondary transfer belt 404 from the secondary transfer nip N2 to the detection position Z2 is minimized to stabilize the distance L2.

The detection position Z2 by the pattern detector 407 is more upstream than the roller 403 as the tension rotator from to the secondary transfer nip N2 in the direction of travel of the secondary transfer belt 404. Therefore, even if a load on the secondary transfer belt 404 changes, and the roller 403 is displaced, the distance L2 is almost unchanged. That is, the distance L2 is stabilized regardless of the tension of the roller 403.

Furthermore, since the secondary transfer roller 36 and the rollers 401, 402, and 403 constitute the secondary transfer device 40 and are attached to the common pressing frame 49, tolerances in the secondary transfer device 40 are minimized, and the distance L2 is set accurately.

With this configuration, the intermediate transfer belt 31 is driven with high accuracy without controlling the intermediate transfer belt 31 based on the distance. In addition, since relation of hardness magnitude between the secondary transfer roller 36 and the secondary-transfer backside roller 33 is determined, the change of the distance L2 due to the displacement of the cam 51 is smaller than that of the distance L1 due to the transfer pressure in the secondary transfer nip N2. Specifically, the hardness of the secondary transfer roller 36 is greater than that of the secondary-transfer backside roller 33 serving as the opposed rotator. Accordingly, the accuracy of the traveling speed of secondary transfer belt 404 is secured.

That is, the test pattern image T1 on the secondary transfer belt 404 is detected with high accuracy.

Figure 9:
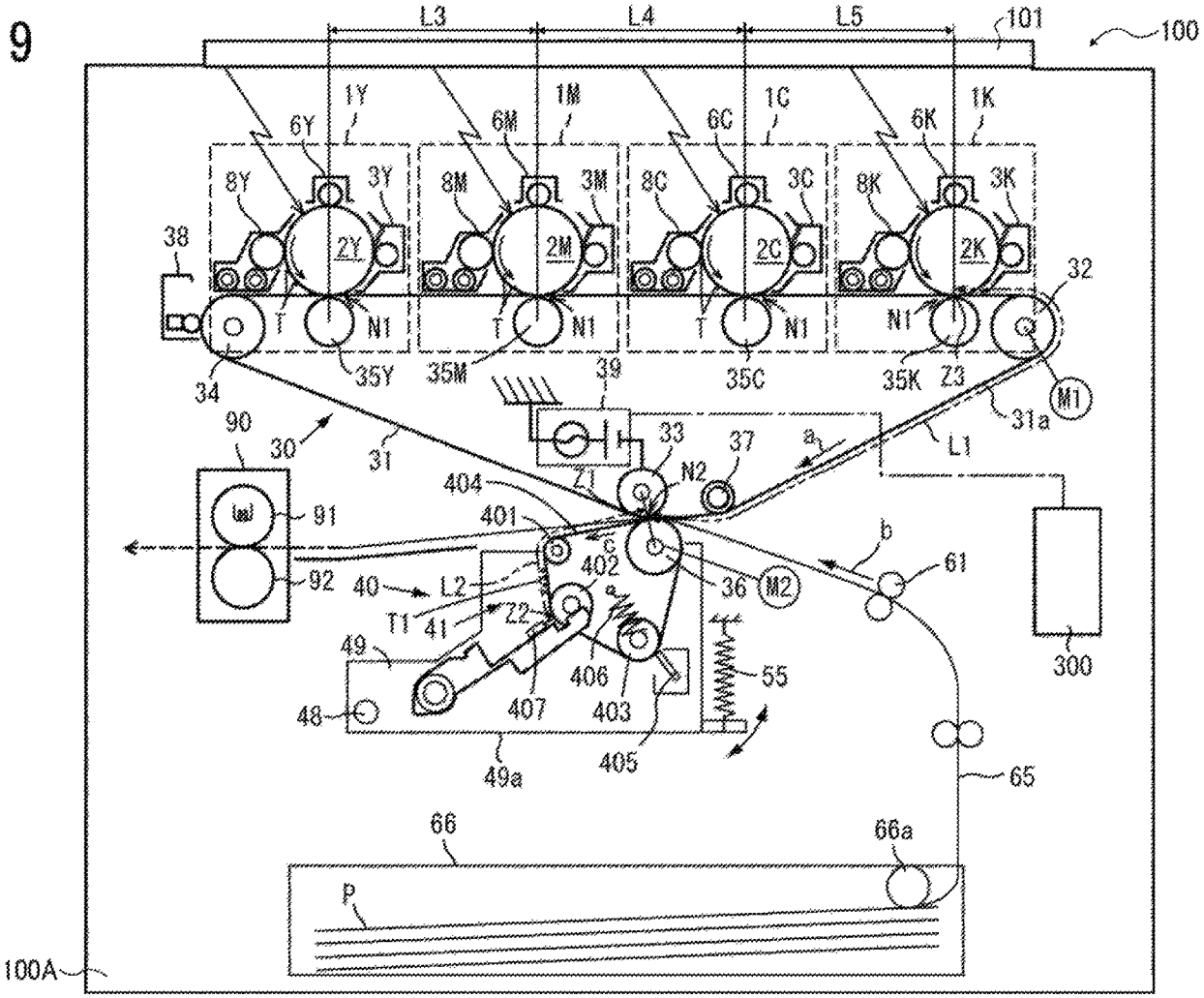
FIG. 9 is a schematic view of a first modification according to the first embodiment.

FIG. 9 illustrates a first modification of the first embodiment in FIG. 1.

The configuration of the image forming apparatus 100 is not limited to embodiments employing the transfer pressure adjuster 50. Thus, in a first modification, there is no transfer pressure adjuster 50 to adjust the transfer pressure at the secondary transfer nip N2 compared with the first embodiment.

In the image forming apparatus without the transfer pressure adjuster 50 to change the transfer pressure at the secondary transfer nip N2, the fluctuation of the transfer pressure occurs not a little. For example, a degradation or tolerances of the tension coil spring 55, or temperature or humidity change may cause the fluctuation of the transfer pressure. However, even if the degradation or the change occurs, since the order of the hardness of the secondary transfer roller 36 and the secondary-transfer backside roller 33 is determined, the accuracy of the traveling speed of secondary transfer belt 404 is secured regardless of the change of the transfer pressure. Specifically, the hardness of the secondary transfer roller 36 is greater than that of the secondary-transfer backside roller 33

Figure 10:
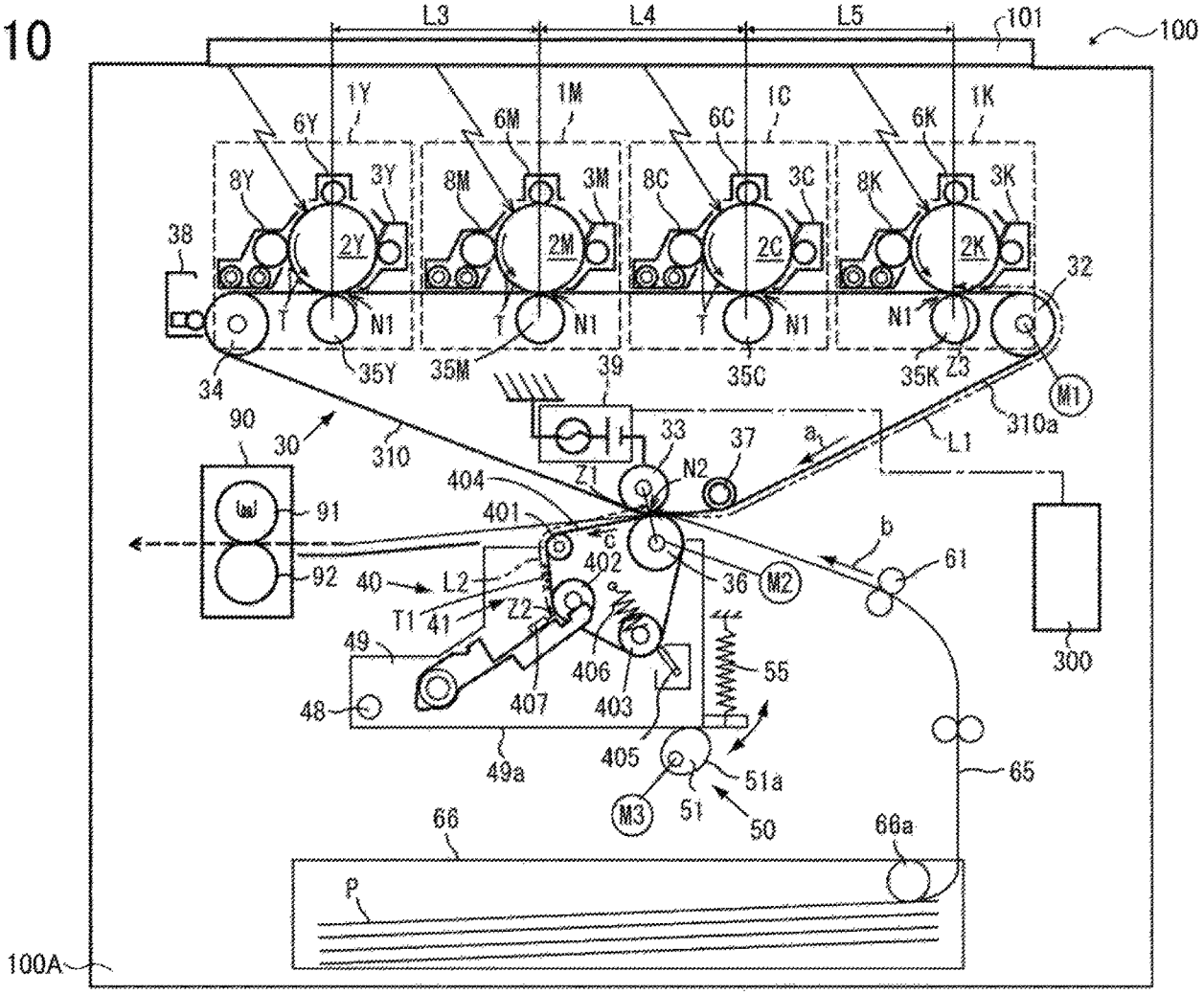
FIG. 10 is a schematic view of a second modification according to the first embodiment.

FIG. 10 illustrates a second modification of the first embodiment in FIG. 1.

The image forming apparatus of the second modification includes an intermediate transfer belt 310 as an intermediate transferor without the scale tape 200 in place of the intermediate transfer belt 31 compared with the first embodiment. The feed-back control using the scale tape 200 is not executed. The intermediate transfer belt 310 has a configuration similar to that of the intermediate transfer belt 31 except presence of the scale tape 200. The test pattern image T1 developed outside image areas on the photoconductor 2 is transferred primarily onto a front surface 310*a* of the intermediate transfer belt 310.

In the second modification, the secondary transfer nip N2 as the secondary transfer area is formed between the intermediate transfer belt 310 and the secondary transfer belt 404, and the secondary transfer belt 404 is pressed against the intermediate transfer belt 310. The configuration of the image forming apparatus 100 is not limited to embodiments employing the intermediate transfer belt 31 with the scale tape 200.

In the present embodiment, since the distance L2 on the secondary transfer belt 404 between the center position Z1 of the secondary transfer nip N2 and the detection position Z2 is the integral multiple of the circumference D2π of the secondary transfer roller 36, the speed of the secondary transfer belt 404 when an image is transferred onto an actual recording medium P in the secondary transfer nip N2 is detected with high accuracy by the pattern detector 407. Accordingly, the accuracy of the traveling speed of secondary transfer belt 404 is secured. In the second modification, the accuracy of the traveling speed of the intermediate transfer belt 310 may decrease without the scale tape 200 compared with the first embodiment. However, if the primary drive motor M1 or the drive roller 32 of the intermediate transfer belt 31 having a small cyclic fluctuation is employed, the accuracy of the traveling speed of the intermediate transfer belt 310 is secured. The small cyclic fluctuation is derived from small tolerances or a small eccentricity.

Second Embodiment

Figure 11:
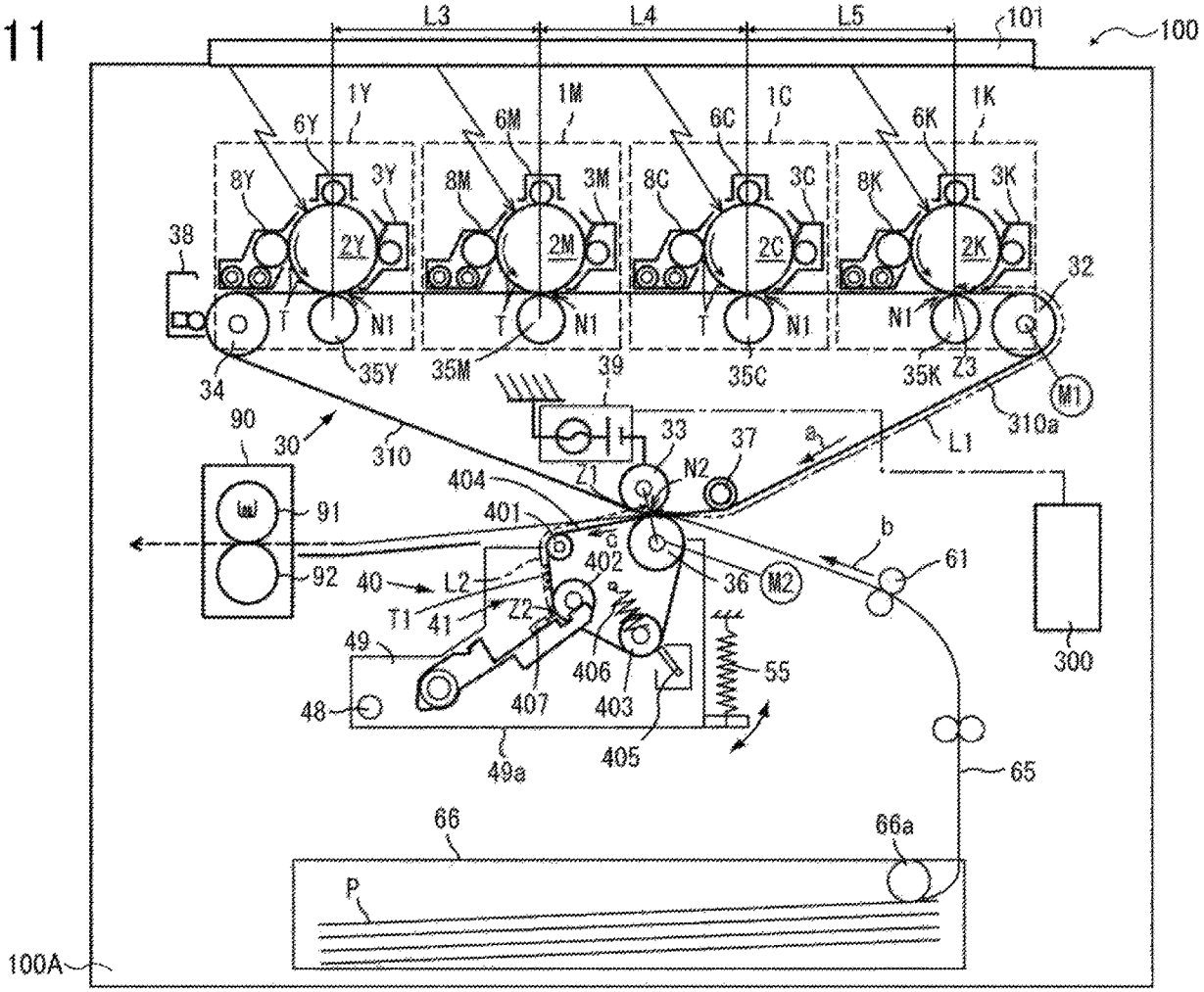
FIG. 11 is a schematic view of an image forming apparatus according to a second embodiment of the present disclosure.

As illustrated in FIG. 11, the image forming apparatus of a second embodiment does not include the transfer pressure adjuster 50 to change the transfer pressure at the secondary transfer nip N2 and the scale tape to be detected for feed-back control of the intermediate transfer belt 31. Furthermore, the distance L1 is an integral multiple of the circumference D2π of the secondary transfer roller 36, and the distance L2 is an integral multiple of the circumference D2π of the secondary transfer roller 36.

With this configuration, a distance L1+L2 from the primary transfer position to the pattern detection position to detect the test pattern image T1 by the pattern detector 407 is an integral multiple of the circumference D2π of the secondary transfer roller 36. The distance L1+L2 is the sum of the distance L1 on the intermediate transfer belt and the distance L2 on the secondary transfer belt. The eccentricity of the secondary transfer roller 36 causes the periodical speed fluctuations of the intermediate transfer belt 31 and the secondary transfer belt 404 respectively because the secondary transfer roller 36 contacts the secondary transfer belt 404 and contact the intermediate transfer belt 31 via the secondary transfer belt 404. The test pattern images T1 at the primary transfer position and the detection position by the pattern detector 407 move on the intermediate transfer belt and the secondary transfer belt respectively under the effect of the periodical speed fluctuations. In the present embodiment, since the distance L1+L2 is the integral multiple of the circumference D2π of the secondary transfer roller 36, the phase of speed fluctuation at the primary transfer position is equivalent to that at the detection position. Accordingly, the periodical speed fluctuation due to the eccentricity of the secondary transfer roller 36 does not affect the detection result to detect the test pattern image T1 by the pattern detector 407. That is, the pattern detector 407 can accurately detect a transfer timing (transfer position) of the test pattern image T1 at the primary transfer position.

The distance L1 and the distance L2 may change a little due to the change of the transfer pressure. However, the detection accuracy of the test pattern image T1 by the pattern detector 407 may be increased compared with the case where the distances L1 or L2 is not the integral multiple of the circumference D2π of the secondary transfer roller 36.

In the embodiments and the modifications described above, the distance L2 on the secondary transfer belt 404 from the center position Z1 of the secondary transfer nip N2 to the detection position Z2 by the pattern detector 407 is the integral multiple of the circumference D2π of the secondary transfer roller 36, but the embodiments are not limited to those configurations. For example, the eccentricity of the secondary transfer roller 36 causes the speed fluctuation of the intermediate transfer belt 310 or the secondary transfer belt 404. Furthermore, the secondary drive motor M2 that is upstream part of a drive system for the secondary transfer roller 36 may causes the speed fluctuation of the intermediate transfer belt 310 or the secondary transfer belt 404. Therefore, instead of the circumference of the secondary transfer roller 36, the distance L1 or L2 is set to an integral multiple of a length equivalent to one rotation of the secondary drive motor M2 serving as a driver to drive the secondary transfer roller 36. Accordingly, similar effects when the distance L1 or L2 is set to the integral multiple of the circumference of the secondary transfer roller 36 may be obtained.

Descriptions are given below of a rotation drive mechanism 420 to drive the secondary transfer roller 36, with reference to FIG. 12.

The rotation drive mechanism 420 includes a secondary transfer gear 421, a drive pulley 422, a tension belt 423, a motor output gear 425, a drive belt 426, and the secondary drive motor M2. The secondary transfer gear 421 is attached to an end of a shaft 360 of the secondary transfer roller 36.

The tension belt 423 is a cogged belt and looped around the secondary transfer gear 421 and the drive pulley 422. The motor output gear 425 is attached to an output shaft M2*a* of the secondary drive motor M2. The drive pulley 422 coaxially includes a small-diameter tension pulley 422*a* and a motor pulley 422*b*. The motor pulley 422*b* is larger in diameter than the tension pulley 422*a*. The tension belt 423 is looped around the tension pulley 422*a* and the secondary transfer gear 421, and the cogged drive belt 426 is looped around the motor pulley 422*b* and the motor output gear 425. Furthermore, the rotation drive mechanism 420 includes a tension roller 424 to give tension to the tension belt 423. The tension roller 424 is employed as needed.

With this configuration, in the rotation drive mechanism 420, as the secondary drive motor M2 rotates the motor output gear 425, the rotation is transmitted to the shaft 360 via the drive belt 426, the drive pulley 422, the tension belt 423, and the secondary transfer gear 421 to rotate the secondary transfer roller 36.

Figure 12:
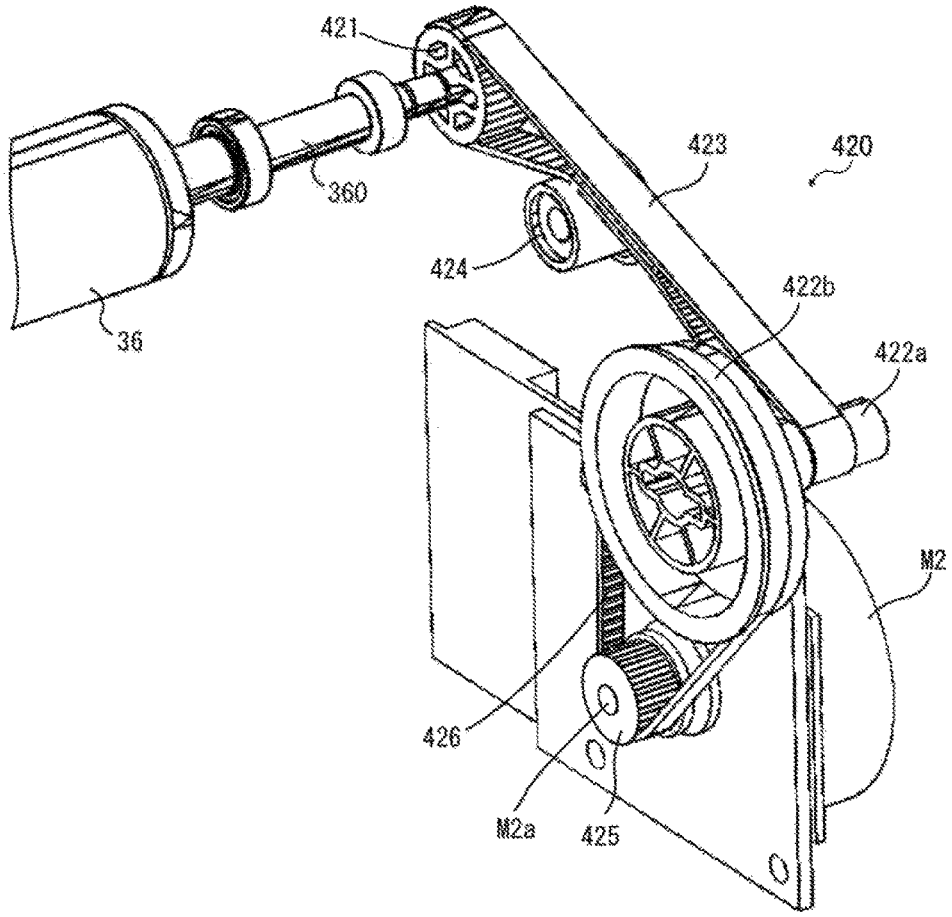
FIG. 12 is an enlarged perspective view of an example of a rotation driving mechanism for a secondary driving rotator.

With the rotation drive mechanism 420 in FIG. 12, a distance equivalent to one rotation of the secondary drive motor M2 is a traveling distance of a surface of the secondary transfer roller 36 during one rotation of the secondary drive motor M2.

The inventors performed an experiment to evaluate the speed fluctuation of the intermediate transfer belt 310 and the secondary transfer belt 404 using the secondary drive motor M2 with different output torque. In the experiment, as the output torque of the secondary drive motor M2 were increased, the speed fluctuations of the intermediate transfer belt 310 and the secondary transfer belt 404 not to improve or improvement rate decreased, even if the distances L1 and L2 were set to the integral multiple of the circumference of the roller.

Then, an experiment of the speed fluctuation of the intermediate transfer belt 310 and the secondary transfer belt 404 was carried out under a condition that the distances L1 and L2 were set to the integral multiple of the distance equivalent to one rotation of the secondary drive motor M2, and the output torque of the secondary drive motor M2 was varied. As a result, though the output torque of the secondary drive motor M2 was increased, the speed fluctuations of the intermediate transfer belt 310 and the secondary transfer belt 404 tended to decrease compared with when the distance L1 or L2 is set to the integral multiple of the circumference of the secondary transfer roller 36.

When the output torque of the secondary drive motor M2 is great, and a resistance or a moment of the secondary drive motor M2 is great, the load of the secondary drive motor M2 contributes more to the speed fluctuation of the intermediate transfer belt 310 and the secondary transfer belt 404 than an eccentricity of the circumference D2π of the secondary transfer roller 36.

Note that, it is more preferable that the distances L1 and L2 are an integral multiple of a circumference D1π of the drive roller 32. Here, a diameter of the drive roller 32 is referred to as D1. Additionally, it is more preferable that the distances L1 and L2 are an integral multiple of a distance equivalent to one rotation of the primary drive motor M1.

Third Embodiment

Descriptions are given of the relation between the distance L2 and the circumference D2π of the secondary transfer roller 36 in the first embodiment and the relation between the distance L2 and the secondary drive motor M2 to rotate the secondary transfer roller 36 in the second embodiment. In the third embodiment, descriptions are given below of relations between a) distance L2 and the circumference D2π of the secondary transfer roller 36, b) the distances L3 through L5 between the primary transfer positions and the circumference D1π of the drive roller 32 (intermediate drive rotator), and c) the circumference D2π of the secondary transfer roller 36 (secondary transfer rotator) and the circumference D1π of the drive roller 32 (intermediate transfer rotator). The configuration of the image forming apparatus in the present embodiment is similar to that of the image forming apparatus 100 illustrated in FIG. 1.

The image forming apparatus in the present embodiment includes the photoconductors 2Y, 2M, 2C, and 2K as a plurality of image bearers. The test pattern image T1 serving as each color toner image for detection is transferred from the photoconductors 2Y, 2M, 2C, and 2K onto the intermediate transfer belt 31 as the intermediate transferor in the primary transfer nip N1 as the primary transfer position. In addition, the distances L3, L4, and L5 between the center positions of the primary transfer nips N1 are set to the integral multiple of the circumference D1π of the drive roller 32, and the circumference D1π of the drive roller 32 is set to the integral multiple of a distance equivalent to one rotation of the primary drive motor M1 to drive the drive roller 32.

With this configuration, the speed fluctuation of the intermediate transfer belt 31 occurs with the eccentricity of the drive roller 32 and the rotation of the primary drive motor M1. If photoconductor pitch (distance L3, L4, or L5 between the two primary transfer nips N1) does not correspond to an integral multiple of the circumference D1π of the drive roller 32, the speed fluctuation causes phase deviations between photoconductors (colors). Therefore, the color shift occurs. However, in the present embodiment, since the distances L3, L4, and L5, the photoconductor pitches between the image forming stations, are integral multiples of the circumference D1π of the drive roller 32, the periodical speed fluctuation of the intermediate transfer belt 31 does not result in the color shift between colors. Therefore, when the color shift of each color is corrected based on the test pattern image T1 that is transferred from the intermediate transfer belt 31 to the secondary transfer belt 404 and detected by the pattern detector 407, the effect of the periodical speed fluctuation of the intermediate transfer belt 31 is eliminated. Accordingly, the color shift can be suppressed (corrected) with high accuracy. Furthermore, in the present embodiment, the circumference D1π of the drive roller 32 is the integral multiple of the distance equivalent to one rotation of the primary drive motor M1 to rotate the drive roller 32. With this configuration, the effect of the periodical speed fluctuation of the intermediate transfer belt 31 due to the periodical fluctuation of the primary drive motor M1 is eliminated. Accordingly, the color shift can be suppressed (corrected) accurately.

Further, in the present embodiment, the circumference of one of the intermediate driving rotator (e.g., the drive roller 32) and the secondary driving rotator is an integral multiple of the circumference of the other. The word "integral multiple of the circumference of the other" includes cases where the circumference D1π of the drive roller 32 is the integral multiple of the circumference D2π of the secondary transfer roller 36, where the circumference D2π of the secondary transfer roller 36 is the integral multiple of circumference D1π of the drive roller 32, and where the circumference D1π of the drive roller 32 is equivalent to the circumference D2π of the secondary transfer roller 36. With this configuration of both rollers, even though the periodical fluctuation of the secondary transfer roller 36 affects the traveling speed of the intermediate transfer belt 31, the color shift between colors due to the speed fluctuation does not occur. Accordingly, the color shift can be suppressed (corrected) accurately.

In the embodiments described above, the word, "integral multiple" is not limited to numerical values without decimal places, for example, exact 2 times or 3 times, but includes some deviations around the integral values. The deviation from "integral multiple" is preferably within ±5%, for example, from 1.95 to 2.05 times in the case of "2", and more preferably within ±2%, for example, from 1.98 to 2.02 times.

The above-described embodiments are illustrative and do not limit the present disclosure. Thus, numerous additional modifications and variations are possible in light of the above teachings. For example, elements or features of different illustrative embodiments may be combined with each other or substituted for each other within the scope of the present disclosure.

For example, the image forming apparatus is not be limited to the printer and may be, for example, a copier, a stand-alone fax machine, or a multifunction peripheral including at least two functions of a copier, a printer, a fax machine, and a scanner.

In the above-described embodiments, the image forming apparatus conveys a recording medium P in a horizontal direction in the secondary transfer position (the secondary transfer nip N2). However, embodiments of this disclosure are not limited to the configuration of horizontal conveyance. For example, the present disclosure is applicable to an image forming apparatus that conveys a recording medium P upward, downward, diagonally upward, or diagonally downward in a secondary transfer area.

In the above-described embodiments, an object to be conveyed is not limited to the recording medium P like a paper sheet but can be a resin sheet like a prepreg sheet, a paper sheet, a film, or cloth.

In the above-described embodiments, the image forming apparatus includes the photoconductors 2Y, 2M, 2C, and 2K as the plurality of image bearers, but a monochrome image forming apparatus including one image bearer can adopt aspects of the present disclosure.

The monochrome image forming apparatus includes an intermediate transfer belt serving as an intermediate transferor, a secondary transfer belt serving as a secondary transferor, and a pattern detector serving as a detector. For example, a test pattern image as a detection image formed on a drum-shaped photoconductor serving as an image bearer is transferred onto the intermediate transfer belt. Then, the test pattern image is transferred from the intermediate transfer belt onto the secondary transfer belt in a secondary transfer nip. The secondary transfer belt is looped around a plurality of rotators serving as a rotator and contacts the intermediate transfer belt to form the secondary transfer nip. The plurality of rotators includes a secondary transfer roller serving as the secondary driving rotator. The pattern detector detects the test pattern image transferred on the secondary transfer belt.

Then, the distance L2 from the secondary transfer nip to the detection position on the secondary transfer belt by the pattern detector is set to an integral multiple of a circumference of the secondary transfer roller or an integral multiple of a distance equivalent to one rotation of the secondary drive motor to rotate the secondary transfer roller.

With this configuration in the monochrome image forming apparatus, the pattern detector can accurately detects the test pattern image T1 on the secondary transfer member. Then, a controller adjusts an image forming position (latent image position) on the image bearer based on the detected result. Accordingly, the misalignment of the image transferred onto the recording medium P is prevented, especially in a conveyance direction of the recording medium P, and the image is transferred at a desirable position on the recording medium P.

The effects obtained by the above-described embodiments are examples. The effects obtained by other embodiments are not limited to the above-described effects.

What is claimed is:

1. An image forming apparatus comprising:

an image bearer configured to bear a detection image;

an intermediate transferor on which the detection image is transferred from the image bearer at a primary transfer position;

a secondary transferor looped around a plurality of rotators and disposed in contact with the intermediate transferor at a secondary transfer position where the detection image is transferred from the intermediate transferor to the secondary transferor, the plurality of rotators including a secondary driving rotator configured to drive the secondary transferor; and a detector configured to detect the detection image on the secondary transferor at a detection position, wherein a distance from the secondary transfer position to the detection position on the secondary transferor is an integral multiple of a circumference of the secondary driving rotator, and wherein a distance from the primary transfer position to the secondary transfer position is an integral multiple of the circumference of the secondary driving rotator.

2. The image forming apparatus according to claim 1, further comprising an intermediate driving rotator configured to drive the intermediate transferor; and a plurality of image bearers, including the image bearer, configured to bear detection images, wherein the detection images on the plurality of image bearers are transferred onto the intermediate transferor at a plurality of primary transfer positions, including the primary transfer position, and wherein a distance between the plurality of primary transfer positions on the intermediate transferor is an integral multiple of a circumference of the intermediate driving rotator.

3. The image forming apparatus according to claim 2, further comprising a primary drive motor configured to drive the intermediate driving rotator, wherein the circumference of the intermediate driving rotator is an integral multiple of a distance equivalent to one rotation of the primary drive motor.

4. The image forming apparatus according to claim 2, wherein one of the circumference of the intermediate driving rotator and the circumference of the secondary driving rotator is an integral multiple of the other of the circumference of the intermediate driving rotator and the circumference of the secondary driving rotator.

5. The image forming apparatus according to claim 1, further comprising an opposed rotator disposed opposite the secondary driving rotator, wherein the intermediate transferor is looped around the opposed rotator, wherein the secondary transfer position is disposed between the opposed rotator and the secondary driving rotator, and wherein a hardness of the secondary driving rotator is greater than a hardness of the opposed rotator.

6. The image forming apparatus according to claim 5, further comprising a transfer pressure adjustor configured to adjust a transfer pressure acting at the secondary transfer position.

7. The image forming apparatus according to claim 1, wherein one of the plurality of rotators around which the secondary transferor is looped is a tension rotator configured to give tension to the secondary transferor, and wherein the detection position on the secondary transferor is disposed between the secondary transfer position and the tension rotator in a direction of travel of the secondary transferor.

8. The image forming apparatus according to claim 1, wherein, one of the plurality of rotators around which the secondary transferor is looped is a detection rotator disposed opposite the detector via the secondary transferor, wherein another rotator of the plurality of rotators is disposed between the secondary transfer position and the detection rotator and is a support rotator without an elastic layer, and wherein the detection position on the secondary transferor is disposed between the secondary transfer position and a tension rotator in a direction of travel of the secondary transferor.

9. The image forming apparatus according to claim 1, further comprising a common support frame configured to support the plurality of rotators, wherein the plurality of rotators is attached to the common support frame.

10. The image forming apparatus according to claim 1, wherein the intermediate transferor is an elastic belt.

11. An image forming apparatus comprising:

an image bearer configured to bear a detection image;

an intermediate transferor on which the detection image is transferred from the image bearer at a primary transfer position;

a secondary transferor looped around a plurality of rotators and disposed in contact with the intermediate transferor at a secondary transfer position where the detection image is transferred from the intermediate transferor to the secondary transferor, the plurality of rotators including a secondary driving rotator configured to drive the secondary transferor;

a detector configured to detect the detection image transferred on the secondary transferor at a detection position; and a secondary drive motor configured to drive the secondary driving rotator, wherein a distance from the secondary transfer position to the detection position on the secondary transferor is an integral multiple of a distance equivalent to one rotation of the secondary drive motor, and wherein a distance from the primary transfer position to the secondary transfer position is an integral multiple of a circumference of the secondary driving rotator.

12. The image forming apparatus according to claim 11, further comprising an intermediate driving rotator configured to drive the intermediate transferor; and a plurality of image bearers, including the image bearer, configured to bear detection images, wherein the detection images on the plurality of image bearers are transferred onto the intermediate transferor at a plurality of primary transfer positions, including the primary transfer position, and wherein a distance between the plurality of primary transfer positions on the intermediate transferor is an integral multiple of a circumference of the intermediate driving rotator.

13. The image forming apparatus according to claim 12, further comprising a drive motor configured to drive the intermediate driving rotator, wherein the circumference of the intermediate driving rotator is an integral multiple of a distance equivalent to one rotation of the drive motor.

14. The image forming apparatus according to claim 12, wherein one of the circumference of the intermediate driving rotator and the circumference of the secondary driving rotator is an integral multiple of the other of the circumference of the intermediate driving rotator and the circumference of the secondary driving rotator.

15. The image forming apparatus according to claim 11, further comprising an opposed rotator disposed opposite the secondary driving rotator, wherein the intermediate transferor is looped around the opposed rotator, wherein the secondary transfer position is disposed between the opposed rotator and the secondary driving rotator, and wherein a hardness of the secondary driving rotator is greater than a hardness of the opposed rotator.

16. The image forming apparatus according to claim 15, further comprising a transfer pressure adjustor configured to adjust a transfer pressure acting at the secondary transfer position.

17. The image forming apparatus according to claim 11, wherein one of the plurality of rotators around which the secondary transferor is looped is a tension rotator configured to give tension to the secondary transferor, and wherein the detection position on the secondary transferor is disposed between the secondary transfer position and the tension rotator in a direction of travel of the secondary transferor.

18. The image forming apparatus according to claim 11, wherein, one of the plurality of rotators around which the secondary transferor is looped is a detection rotator disposed opposite the detector via the secondary transferor, wherein another rotator of the plurality of rotators is disposed between the secondary transfer position and the detection rotator and is a support rotator without an elastic layer, and wherein the detection position on the secondary transferor is disposed between the secondary transfer position and a tension rotator in a direction of travel of the secondary transferor.

* * * * *